US007464493B2

(12) United States Patent
Ishikawa et al.

(10) Patent No.: US 7,464,493 B2
(45) Date of Patent: Dec. 16, 2008

(54) WORK MACHINE

(75) Inventors: Kouji Ishikawa, Tsuchiura (JP); Tadatoshi Shimamura, Tsuchiura (JP); Hidetoshi Satake, Tsuchiura (JP); Nobuei Ariga, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 1 day.

(21) Appl. No.: 11/661,972

(22) PCT Filed: Sep. 8, 2005

(86) PCT No.: PCT/JP2005/016538

§ 371 (c)(1),
(2), (4) Date: Mar. 6, 2007

(87) PCT Pub. No.: WO2006/028182

PCT Pub. Date: Mar. 16, 2006

(65) Prior Publication Data

US 2007/0261277 A1 Nov. 15, 2007

(30) Foreign Application Priority Data

Sep. 10, 2004 (JP) ..... 2004-264242

(51) Int. Cl.
*E02F 5/02* (2006.01)
*G05D 1/02* (2006.01)

(52) U.S. Cl. ..... 37/348; 37/414; 91/291; 60/431

(58) Field of Classification Search ..... 37/348, 37/382, 414, 347; 414/699–701; 172/2, 172/4, 4.5, 7; 91/291, 293, 308; 123/198 D, 123/198 DB; 60/431
See application file for complete search history.

(56) References Cited

U.S. PATENT DOCUMENTS 4,452,196 A * 6/1984 Indra ..... 123/198 DB (Continued)

FOREIGN PATENT DOCUMENTS

AU B-36574/89 2/1990

(Continued)

OTHER PUBLICATIONS

International Search Report dated Oct. 25, 2005 with English translation of relevant portion (Four (4) pages).

*Primary Examiner*—Thomas A Beach
(74) *Attorney, Agent, or Firm*—Crowell & Moring LLP

(57) ABSTRACT

A work machine is provided having a starter motor for starting a prime mover, which without provision of any special hydraulic equipment, allows for draining pressure oil that still remains in a hydraulic actuator for driving a front attachment. The work machine is provided with a boom cylinder for driving a front attachment, a flow rate control valve for controlling a flow of pressure oil to be supplied to the boom cylinder, and a pilot valve for producing an output of a pilot control signal, which serves to switch the flow rate control valve, by using, as a primary pressure, pressure oil delivered from a pilot hydraulic pump driven by an engine. A fuel stop switch is provided for performing stop control on a supply of fuel, which drives the engine, and a switch is provided for maintaining drivable a starter motor, which starts the engine, responsive to the stop control of the supply of fuel to the engine by the fuel stop switch.

5 Claims, 2 Drawing Sheets

U.S. PATENT DOCUMENTS

| | | | | |
|---|---|---|---|---|
| 4,541,243 | A * | 9/1985 | Clark | 60/595 |
| 4,606,708 | A * | 8/1986 | Clark | 417/380 |
| 5,535,712 | A * | 7/1996 | Matsubara et al. | 123/179.4 |
| 7,019,668 | B2 * | 3/2006 | Kinugawa | 340/870.16 |

FOREIGN PATENT DOCUMENTS

| | | | |
|---|---|---|---|
| EP | 1 300 519 | A9 | 4/2003 |
| JP | 2-85018 | A | 3/1990 |
| JP | 6-49867 | A | 2/1994 |
| JP | 7-238902 | A | 9/1995 |
| JP | 7-317713 | A | 12/1995 |
| JP | 2000-65003 | A | 3/2000 |
| JP | 2000-96631 | A | 4/2000 |
| JP | 2001-99103 | A | 4/2001 |
| JP | 2001-336177 | A | 12/2001 |
| JP | 2004-68975 | A | 3/2004 |
| WO | WO 01/92651 | A1 | 12/2001 |

* cited by examiner

WORK MACHINE

TECHNICAL FIELD

This invention relates to a work machine, which is provided with a starter motor for starting a prime mover and allows to drain pressure oil, which still remains in a hydraulic actuator, by making use of drive force of the starter motor.

BACKGROUND ART

A conventional technology provided with a starter motor for starting a prime mover includes a technique disclosed in Patent Document 1. This conventional technique is provided with a primer mover, specifically an engine, a starter motor for starting the engine, a main hydraulic pump and pilot hydraulic pump drivable by the engine, a swing motor, specifically a hydraulic actuator drivable by pressure oil supplied from the main hydraulic pump, a directional control valve, specifically a flow rate control valve for controlling a flow of pressure oil to be supplied to the hydraulic actuator, and a pilot valve, specifically a control device for producing an output of a pilot control signal to switch the flow rate control valve by using, as a primary pressure, pressure oil delivered from the pilot hydraulic pump.

The conventional technique is also provided with a selector valve in a line, which communicates the pilot hydraulic pump and the pilot valve with each other, to prevent the output of the pilot control signal from the pilot valve. This selector valve is provided with a first select position and a second select position. At the first select position, the primary pressure from the pilot hydraulic pump can be supplied to the pilot valve. At the second select position, on the other hand, the supply of the primary pressure from the pilot hydraulic pump to the pilot valve is maintained disabled, and the pilot valve is brought into communication with a reservoir. The conventional technique is designed such that, when the selector valve is switched to the second selected position, the output of the pilot control signal from the pilot valve is prevented.

The conventional technique is further provided with a relay and a switch interposed between the relay and a power supply. The relay maintains the starter motor drivable while the selector valve remains switched to the above-mentioned second select position.

The conventional technique is also designed such that, when the above-mentioned switch is turned on with the selector valve having been switched to the second select position at which the supply of a primary pressure from the pilot hydraulic pump to the pilot valve is disabled, the starter motor is driven to start the engine.

Although not indicated clearly in Patent Document 1 referred to in the above, the conventional technique is designed such that fuel is supplied to the engine generally at the same time as the driving of the starter motor, and subsequent to low-speed rotation by the starter motor, the engine speed increases to such revolutions per minute as permitting driving the hydraulic actuator to perform work by the above-mentioned supply of fuel. In other words, the conventional technique is designed such that in a low-revolution state of the engine by revolutions of the starter motor, the driving of the hydraulic actuator cannot be realized to such extent as performing work.

In the state that the selector valve has been switched to the second select position at which the supply of the primary pressure from the pilot hydraulic pump to the pilot valve is maintained disabled, on the other hand, no pilot control signal is outputted to switch the flow rate control valve even when the pilot valve is controlled. Accordingly, the flow rate control valve is maintained neutral so that safety is maintained without causing any unexpected drive of the hydraulic actuator. When it is not desired to cause any unexpected drive of the hydraulic actuator as in the case that an operator moves away from the operator's seat, the above-mentioned selector valve can be switched to the second select position.

In a work machine to which the above-mentioned conventional technique is applied, for example, a hydraulic excavator illustrated in FIG. 2, it is a common practice at the time of maintenance to drain pressure oil which still remains in a hydraulic actuator, for example, a boom cylinder 34 for driving a front attachment 35, including a boom and the like. Described specifically, when the front attachment 35 of the hydraulic excavator stays standstill in the air as illustrated in FIG. 2, a pressure remains on the bottom side of the boom cylinder 34. Disconnection of a bottom hose from the bottom side of the boom cylinder 34 in this state without advance drainage or the like results in the spouting of oil, thereby contaminating the surrounding area. Moreover, such disconnection is dangerous, because the front attachment 35 suddenly falls down. For these reasons, it is necessary to drain the boom bottom pressure, that is, pressure oil from the bottom side of the boom cylinder 34 beforehand upon conducting maintenance such as the replacement of the bottom hose.

The work to drain the pressure oil, which still remains on the bottom side of the boom cylinder 34, is performed after lowering the front attachment 35, which is staying in the air, to the ground. As a result, a substantial amount of pressure oil still remaining in the boom cylinder 34 can be drawn out. The pressure oil which still remains in the boom cylinder 34 can be drawn out further by quickly moving a control lever of the control device alternately and repeatedly in normal and reverse directions.

As the technology for drawing out, as mentioned above, pressure oil still remaining in a hydraulic actuator, another conventional technique has been proposed as disclosed in Patent Document 2. This another conventional technique is constructed including special hydraulic equipment, such as an accumulator or a pressure oil drain valve, to drain pressure oil which still remains in the hydraulic actuator.

Patent Document 1: JP-A-6-49867

Patent Document 2: JP-A-7-238902

DISCLOSURE OF THE INVENTION

Problems to be Solving by the Invention

The arrangement of an accumulator or pressure oil drain valve such as that disclosed in Patent Document 2 as a technique for draining pressure oil, which still remains in a hydraulic actuator, at the time of maintenance as mentioned above in a work machine provided with a starter motor for starting an engine as illustrated, for example, in Patent Document 1 means that the work machine is provided with special hydraulic equipment. This approach, therefore, involves problems in that the construction becomes complex and as a result, higher equipment cost is required for draining pressure oil which still remains in the hydraulic actuator.

The present invention has been completed under the above-mentioned circumstances of the conventional technology, and its object is, therefore, to provide a work machine that allows to drain pressure oil, which still remains in a hydraulic actuator for driving a front attachment, without arrangement of any special hydraulic equipment.

Means for Solving the Problems

To achieve the above-described object, the present invention provides a work machine provided with a front attachment, a prime mover, a starter for starting the prime mover, a main hydraulic pump and pilot hydraulic pump drivable by the prime mover, a hydraulic actuator for being supplied with pressure oil from the main hydraulic pump to drive the front attachment, a flow rate control valve for controlling a flow of pressure oil to be supplied to the hydraulic actuator, and a control device for producing an output of a pilot control signal to switch the flow rate control valve by using, as a primary pressure, pressure oil delivered from the pilot hydraulic pump, comprising: a fuel stop means for performing stop control on a supply of fuel which drives the prime mover, and a holding means for maintaining the starter motor drivable responsive to the stop control on the supply of fuel to the prime mover by the fuel stop means.

In the present invention constructed as described above, the fuel stop means is actuated to perform stop control on the supply of fuel to the prime mover upon drawing out the pressure oil still remaining in the hydraulic actuator, for example, with the front attachment being held standstill in the air. Responsive to the stop control on the supply of fuel by the fuel stop means, the starter motor is maintained drivable by the holding means. When the starter is driven in this state, the prime mover begins to revolve at low speed by the starter motor. As a result, the main hydraulic pump and pilot hydraulic pump are driven. Due to the above-mentioned low-speed revolutions, the pressure oil delivered from the main hydraulic pump does not reach such a high flow rate as enabling to drive the hydraulic actuator to perform work. However, the pressure oil delivered from the pilot hydraulic pump, that is, the primary pressure can reach a level sufficient to produce a pilot control signal for switching the flow rate control valve.

When the control device is operated in the state that the prime mover is driven at a low rotational speed by the starter motor alone as described above, a pilot control signal which corresponds to pressure oil delivered from the pilot hydraulic pump is outputted to the flow rate control valve so that the flow rate control valve can be switched. By this switching of the flow rate control valve, the front attachment which has stayed standstill in the air descends by its own weight. As a result, the pressure oil which still remains in the hydraulic actuator is drained. When the control device is quickly operated alternately and repeatedly in normal and reverse directions with the front attachment being maintained in contact with the ground, the pressure oil which still remains in the hydraulic actuator can be drained further.

It is to be noted that the holding means for maintaining the starter motor drivable responsive to the stop control on the supply of fuel to the prime mover by the above-mentioned fuel stop means can be easily constructed by a switch or the like.

As described above, the present invention can draw out pressure oil, which still remains in the hydraulic actuator, without the arrangement of any special hydraulic equipment such as an accumulator or pressure oil drain valve owing to the arrangement of the holding means for maintaining the starter motor drivable responsive to the stop control on the supply of fuel to the prime mover by the fuel stop means.

In the present invention as described above, the control device may comprise a pilot valve for outputting the pilot control signal, the work machine may be provided with a selector valve arranged in a line, which communicates the pilot hydraulic pump with the pilot valve each other, to prevent the output of the pilot control signal, and the starter motor may be maintained drivable while the output of the pilot control signal is prevented by the selector valve.

According to the present invention constructed as described above, the starter motor is maintained drivable while the output of a pilot control signal, which switches the flow rate control valve by the selector valve, is prevented. Driving of the starter motor in this state, therefore, starts the prime mover. At this time, fuel is concurrently fed to the prime mover. As a consequence, the rotational speed of the prime mover increases beyond the rotational speed achieved by the starter motor, and from the main hydraulic pump, pressure oil is delivered at such a flow rate as permitting the performance of work.

When the pilot valve is operated in this state subsequent to cancellation of the prevention of the output of a pilot control signal by the selector valve, the pilot control signal is outputted from the pilot valve to the flow rate control valve. The flow rate control valve is hence switched, so that the pressure oil delivered from the main hydraulic pump is supplied to the hydraulic actuator via the flow rate control valve. As a result, the hydraulic actuator is driven to permit the performance of the desired work via the front attachment.

In such a case as the operator moves away from the operator's seat, the selector valve is switched to prevent the output of a pilot control signal from the pilot valve. As a result, the flow rate control valve is rendered neutral so that the pressure oil delivered from the main hydraulic pump is no longer supplied to the hydraulic actuator. The hydraulic actuator is, therefore, maintained undrivable. Namely, a safety function is assured to hold the front attachment standstill.

In the present invention, the selector valve may comprise a gatelock valve.

In the present invention, the work machine may be provided with a controller for controlling the supply of fuel which drives the prime mover, the fuel stop means may comprise a fuel stop switch for turning off a power supply for the controller, and the holding means may comprise a switch for maintaining drivable the starter motor in association with the fuel stop switch.

In the present invention, the work machine may comprise a hydraulic excavator, the front attachment may include a boom, and the hydraulic actuator may comprise a boom cylinder.

Advantageous Effects of the Invention

The present invention is provided with the holding means for maintaining the starter motor movable responsive to stop control on a supply of fuel to the prime mover by the fuel stop means. Upon drawing out pressure oil, which still remains in the hydraulic actuator, in the state that the front attachment stays standstill in the air, it is, therefore, only necessary to perform the stop control on the supply of fuel to the prime mover by the fuel stop means and to drive the starter motor rendered drivable by the holding means responsive to the stop control. Operation of the control device in this state switches the flow rate control valve, thereby making it possible to draw out pressure oil, which still remains in the hydraulic actuator, by using the own weight of the front attachment without the arrangement of a special hydraulic equipment as in the conventional art. The holding means may have a simple construction such as a switch. Compared with the conventional art, it is hence possible to reduce the equipment cost required for drawing out pressure oil still remaining in the hydraulic actuator.

BEST MODE FOR CARRYING OUT THE INVENTION

A best mode for carrying out the invention will hereinafter be described based on the drawings.

A work machine according to this embodiment is, for example, a hydraulic excavator as shown in FIG. 2. The hydraulic excavator is provided with a front attachment 35, which includes a boom, and a hydraulic actuator, specifically a boom cylinder 34 for driving the boom included in the front attachment 35.

FIG. 1 is a circuit diagram illustrating the work machine according to the embodiment of the present invention. As depicted in FIG. 1, this embodiment is provided with a prime mover, specifically an engine 1 and a starter motor 2 for staring the engine 1. The starter motor 2 is connected to a power supply 4 via a relay 16 and a wiring 3. Arranged in the wiring 3 is a switch 5 for driving the starter motor 2.

The embodiment is also provided with a main hydraulic pump 6 and pilot hydraulic pump 10 drivable by the engine 1, a flow rate control valve 8 for controlling a flow of pressure oil to be supplied from the main hydraulic pump 6 to the above-mentioned hydraulic actuator, specifically the boom cylinder 34 via a main line 9, and a control device, specifically a pilot valve 11 for producing the output of a pilot control signal, which switches the flow rate control valve 8, by using, as a primary pressure, pressure oil delivered from the pilot hydraulic pump 10.

The pilot valve 11 is provided with reducing valves 11*a*, 11*b* and a control lever 11*c* for actuating these reducing valves 11*a*, 11*b*. The reducing valve 11*a* is connected to a first pilot chamber 8*a* of the flow rate control valve 8 via a pilot line 14*a*, while the reducing valve 11*b* is connected to a second pilot chamber 8*b* of the flow rate control valve 8 via a pilot line 14*b*.

Further, a selector valve 15 which prevents the output of a pilot control signal from the pilot valve 11 is arranged in a line 13 via which the pilot hydraulic pump 10 and the pilot valve 11 are connected with each other. This selector valve 15 is disposed, for example, in an operator's cab of the hydraulic excavator to constitute a control lever 15*a* to be operated by the operator sitting in the operator's seat, in other words, a gatelock valve switchable by a gatelock lever. The selector valve 15 is equipped with a first select position d and a second select position C. At the first select position d, the selector valve 15 allows to supply a primary pressure from the pilot hydraulic pump 10 to the pilot valve 11. At the second select position C, on the other hand, the selector valve 15 remains impossible to supply a primary pressure from the pilot hydraulic pump 10 to the pilot valve 11 and also brings the pilot valve 11 into communication with a reservoir. It is also designed to prevent the output of a pilot control signal from the pilot valve 11 when the selector valve 15 is switched to the second select position C.

This embodiment is also provided with a switch 18 and a wiring 17. The switch 18 is arranged in association with the control lever 15*a* of the selector valve 15, and is turned on when the selector valve 15 is switched to the first select position d by the control lever 15*a* or is turned off when the selector valve 15 is switched to the second select position C. The wiring 17 connects the switch 18 and the above-mentioned relay 16 with each other. The embodiment is constructed such that the relay 16 is in a closed state when the switch 18 is off as illustrated in FIG. 1 but is energized into an open state when the switch 18 is turned on.

In particular, this embodiment is provided with a fuel stop means, for example, a fuel stop switch 31 for performing stop control on a supply of fuel which drives the engine 1. This fuel stop switch 31 is arranged between a controller 32, which controls a fuel injection pump 33 for supplying fuel to drive the engine 1, and the power supply 4. When this fuel stop switch 31 is turned off, the controller 32 is powered off and the operation of the fuel injection pump 33 is stopped to terminate the supply of fuel to the engine 1. When the fuel stop switch 31 is turned off, on the other hand, the controller 32 is powered on, and by a control signal outputted from this controller 32, the fuel injection pump 33 is driven to feed fuel to the engine 1.

This embodiment is further provided with a holding means for maintaining the starter motor 2 drivable, for example, in association with the fuel stop switch 31, responsive to the above-mentioned stop control on the supply of fuel by the fuel stop switch 31, that is, the turning off of the fuel stop switch 31. This holding means comprises a switch 30 arrange, for example, in parallel with the relay 16. When the fuel stop switch 31 is turned off, the switch 30 is turn on in association with the turn-off of the fuel stop switch 31 so that the starter motor 2 is brought into a drivable state. It is also constructed such that, when the fuel stop switch 31 is turned on, the switch 30 is turned off in association with the turn-off of the fuel stop switch 31.

The embodiment constructed as described above operates as will be described hereinafter.

For example, as soon as the operator sitting in the operator's seat begins to move out of the operator's cab, the switch 5 is turned off, and the gatelock lever, specifically the control lever 15*a* of the selective valve 15 is operated to switch the selector lever 15 to the second select position C as shown in FIG. 1. As a consequence, a primary pressure can no longer be supplied from the pilot hydraulic pump 10 to the pilot valve 11. No pilot control signal is hence outputted to the first pilot chamber 8*a* or second pilot chamber 8*b* of the flow rate control valve 8 even when the control lever 11*c* of the pilot valve 11 is operated. As a result, the flow rate control valve 8 is rendered neutral so that the boom cylinder 34 is held standstill. Namely, safety is assured without causing a descend of the like of the front attachment 35, for example, even when a person other than the above-mentioned operator carelessly operates the control lever 11*c* of the pilot valve 11.

When the selector valve 15 is switched to the second select position C as mentioned above, the switch 18 is turned off, and the relay 16 is brought into a closed state so that the starter motor 2 is maintained in a drivable state via the relay 16. In other words, the engine is maintained in a startable state.

For example, when the above-mentioned operator returns again to the operator's seat and turns on the switch 5, the starter motor 2 is driven to start the engine 1. When the fuel stop switch 31 is maintained on at this time as illustrated in FIG. 1, the fuel injection pump 33 supplies fuel to the engine 1 in accordance with a control signal from the controller 32, and the rotational speed of the engine 1 increases from a low rotational speed achieved by the starter motor 2 to a predetermined rotational speed at which work is feasible.

When the gatelock lever, specifically the control lever 15*a* is operated in this state to switch the selector valve 15 to the first select position d, the pilot hydraulic pump 10 is brought into communication with the pilot valve 11 via the selector valve 15 so that a primary pressure delivered from the pilot hydraulic pump 10 driven by the engine 1 is supplied to the pilot valve 11. When the switch 18 is turned on as a result of the above-mentioned operation of the control lever 15*a*, the relay 16 is energized to take an open state so that the drive of the starter motor 2 is stopped. The engine 1 is then continuously driven by the above-mentioned fuel.

When the control lever 11*c* of the pilot valve 11 is operated in such a state, a pilot control signal is outputted from the reducing valve 11*a* or reducing valve 11*b* to the pilot line 14*a* or pilot line 14*b*. This pilot control signal is delivered to the first pilot chamber 8*a* or second pilot chamber 8*b* of the flow rate control valve 8 so that the flow rate control valve 8 is switched. As a result, the pressure oil delivered from the main hydraulic pump 6 is supplied to the boom cylinder 34 via the main line 9 and the flow rate control valve 8, and therefore, the boom cylinder 34 is operated to drive the boom. Namely, the front attachment 35 shown in FIG. 2 is driven to perform the desired work.

Especially when drawing out the pressure oil, which still remains in the boom cylinder 34, at the time of a maintenance in the sate that the front attachment 35 is held standstill in the air, for example, as illustrated in FIG. 2, the fuel stop means is actuated, specifically the fuel stop switch 31 is turned off. As a consequence, the controller 32 is powered off, thereby stopping the supply of fuel from the fuel injection pump 33 to the engine 1. The switch 30 is turned on in association with the above-mentioned turn-off of the fuel stop switch 30 to bring the starter motor 2 into a drivable state. When the switch 5 is turned on, the starter motor 2 is therefore driven so that the engine 1 begins to rotate at a low rotational speed only by the drive force of the starter motor 2 without relying upon a supply of fuel. When the control lever 15*a* is operated, for example, to switch the selector valve 15 to the first select position d in such a state, a primary pressure is supplied from the pilot hydraulic pump 10 to the pilot valve 11.

As the rotational speed of the engine 1 is of such a low level as achieved only by the drive force of the starter motor 2 in this case, the flow rate of the pressure oil delivered from the main hydraulic pump 6 as a result of the operation of the engine 1 does not increase to such a flow rate as permitting the drive of the boom cylinder 34 for the performance of work. Even at a low rotational speed of the engine 1 achievable at the time of its driving by the starter motor 2, however, the primary pressure which is the pressure of the pressure oil delivered from the pilot hydraulic pump 10 can be raised to a level sufficient to produce a pilot control signal which switches the flow rate control valve 8.

When the control lever 11*c* of the pilot valve 11 is operated in a direction b in FIG. 1 in the state that the engine 1 is operated at such a low rotational speed as achievable only by the starter motor 2 as described above, a pilot control signal corresponding to the pressure oil delivered from the pilot hydraulic pump 10 is delivered from the pilot valve 11 to the second pilot chamber 8*b* of the flow rate control valve 8 via the pilot line 14*b* so that the flow rate control valve 8 is switched to a select position Y in FIG. 1. Consequently, the bottom side of the boom cylinder 34 is brought into communication with the reservoir, and the front attachment 35 which has been maintained standstill in the air descends by its own weight. As a result, the boom cylinder 34 retracts so that the pressure oil still remaining in the boom cylinder 34 is drained. When the control lever 11*c* of the pilot valve 11 is quickly operated alternately and repeatedly in the normal and reverse directions, that is, in a direction a and a direction b in FIG. 1 with the front attachment 35 being maintained in contact with the ground as described above, the pressure oil still remaining in the boom cylinder 34 can be drained further.

The holding means, which is switched in association with the fuel controls witch 31 and maintains the starter motor 2 drivable, is constructed of the switch 30. Therefore, the construction of the holding means is simple.

As has been described above, the above embodiment makes it possible to draw out pressure oil, which still remains in the boom cylinder 34, without arrangement of any special hydraulic equipment such as an accumulator or pressure oil drain valve owing to the arrangement of the switch 30 which maintains the starter motor drivable in association with the fuel stop switch 31. Namely, the arrangement of the switch 30 of the simple construction has made it possible to draw out pressure oil still remaining in the boom cylinder 34 and hence to reduce the equipment cost required at the time of a maintenance to draw out the pressure oil remaining in the boom cylinder 34.

LEGEND

Figure 1:
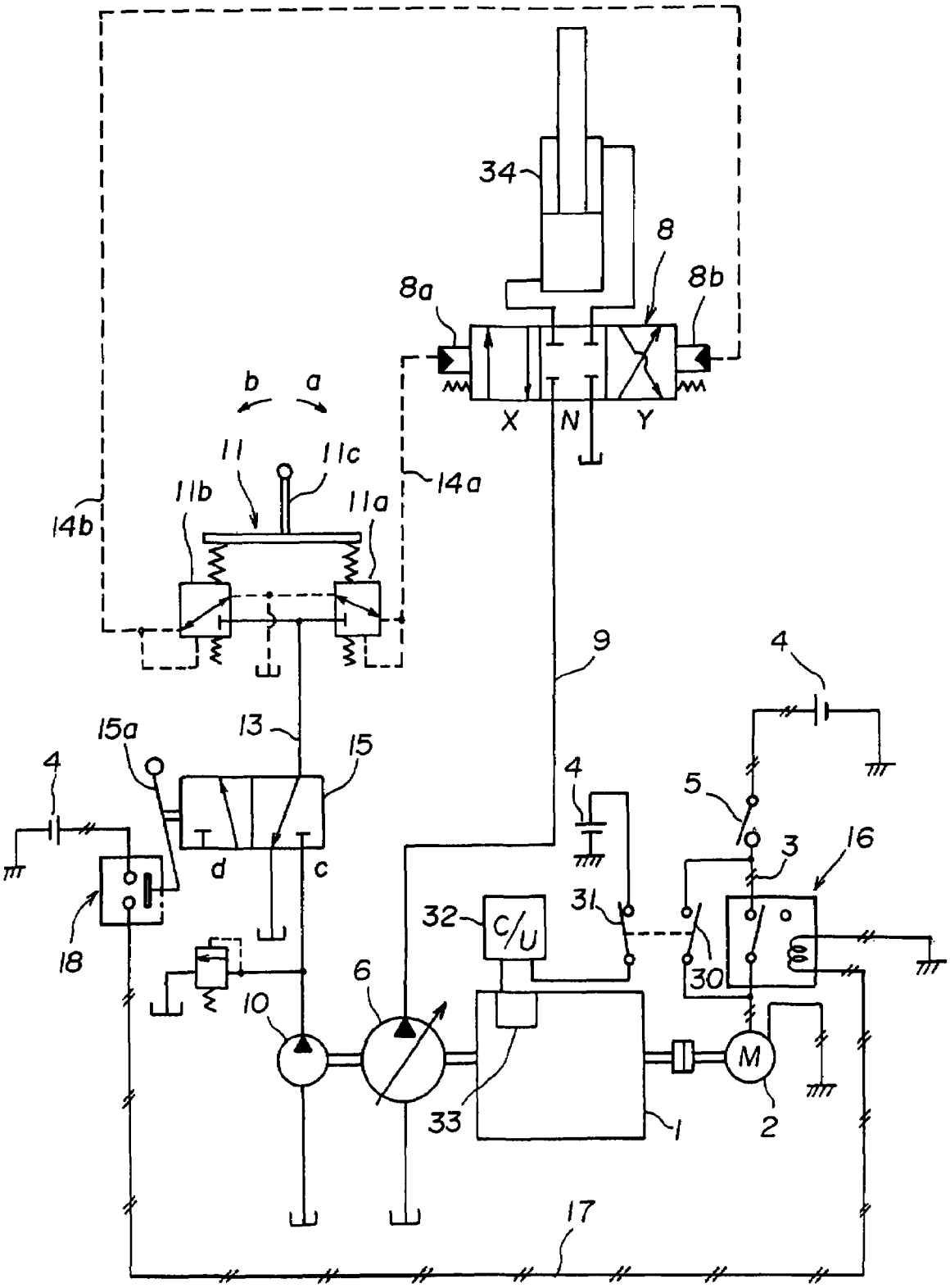
[FIG. 1] A circuit diagram illustrating one embodiment of a work machine according to the present invention.
Figure 2:
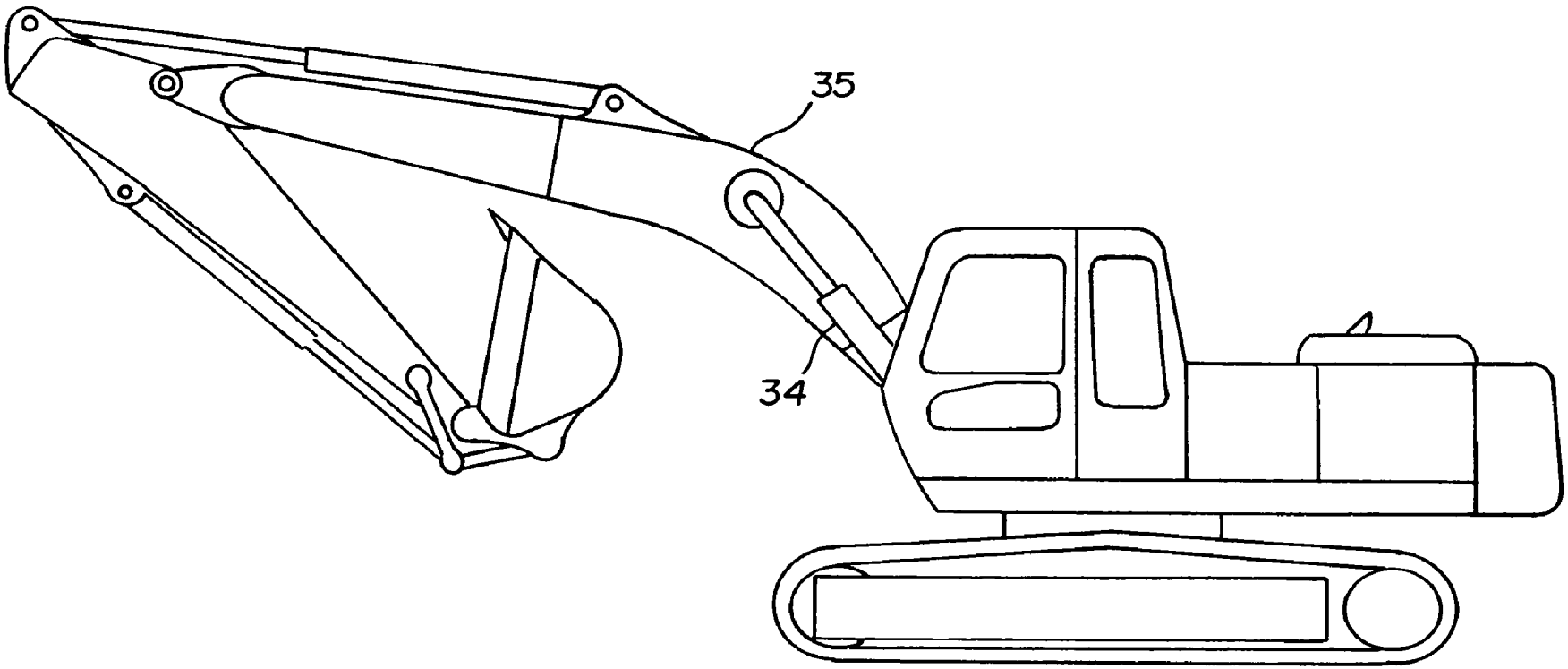
[FIG. 2] Aside view showing a hydraulic excavator referred to as an example of the work machine to which the present invention can be applied.

1 Engine (prime mover)
2 Starter motor
3 Wiring
4 Power supply
5 Switch
6 Main hydraulic pump
8 Flow rate control valve
8*a* First pilot chamber
8*b* Second pilot chamber
9 Main line
10 Pilot hydraulic pump
11 Pilot valve (control device)
11*a* Reducing valve
11*b* Reducing valve
11*c* Control lever
13 Line
14*a* Pilot line
14*b* Pilot line
15 Selector valve
15*a* Control lever
16 Relay
17 Wiring
18 Switch
30 Switch (holding means)
31 Fuel stop switch (fuel stop means)
32 Controller
33 Fuel injection pump
34 Boom cylinder (hydraulic actuator)
35 Front attachment

The invention claimed is:

1. A work machine provided with a front attachment, a prime mover, a starter motor for starting said prime mover, a main hydraulic pump and pilot hydraulic pump drivable by said prime mover, a hydraulic actuator for being supplied with pressure oil from said main hydraulic pump to drive said front attachment, a flow rate control valve for controlling a flow of pressure oil to be supplied to said hydraulic actuator, and a control device for producing an output of a pilot control signal to switch said flow rate control valve by using, as a primary pressure, pressure oil delivered from said pilot hydraulic pump, comprising:

a fuel stop means for performing stop control on a supply of fuel which drives said prime mover, and a holding means for maintaining said starter motor drivable without driving said prime mover responsive to said stop control on said supply of fuel to said prime mover by said fuel stop means.

2. A work machine provided with a front attachment, a prime mover, a starter motor for starting said prime mover, a main hydraulic pump and pilot hydraulic pump drivable by said prime mover, a hydraulic actuator for being supplied with pressure oil from said main hydraulic pump to drive said front attachment, a flow rate control valve for controlling a flow of pressure oil to be supplied to said hydraulic actuator, and a control device for producing an output of a pilot control signal to switch said flow rate control valve by using, as a primary pressure, pressure oil delivered from said pilot hydraulic pump, comprising:

a fuel stop means for performing stop control on a supply of fuel which drives said prime mover, and a holding means for maintaining said starter motor drivable responsive to said stop control on said supply of fuel to said prime mover by said fuel stop means, wherein:

said control device comprises a pilot valve for outputting said pilot control signal, said work machine is provided with a selector valve arranged in a line, which communicates said pilot hydraulic pump with said pilot valve each other, to prevent said output of said pilot control signal, and said starter motor is maintained drivable while said output of said pilot control signal is prevented by said selector valve.

3. A work machine according to claim 2, wherein said selector valve comprises a gatelock valve.

4. A work machine provided with a front attachment, a prime mover, a starter motor for starting said prime mover, a main hydraulic pump and pilot hydraulic pump drivable by said prime mover, a hydraulic actuator for being supplied with pressure oil from said main hydraulic pump to drive said front attachment, a flow rate control valve for controlling a flow of pressure oil to be supplied to said hydraulic actuator, and a control device for producing an output of a pilot control signal to switch said flow rate control valve by using, as a primary pressure, pressure oil delivered from said pilot hydraulic pump, comprising:

a fuel stop means for performing stop control on a supply of fuel which drives said prime mover, and a holding means for maintaining said starter motor drivable responsive to said stop control on said supply of fuel to said prime mover by said fuel stop means wherein:

said work machine is provided with a controller for controlling said supply of fuel which drives said prime mover, said fuel stop means comprises a fuel stop switch for turning off a power supply for said controller, and said holding means comprises a switch for maintaining drivable said starter motor in association with said fuel stop switch.

5. A work machine according to claim 1, wherein:

said work machine comprises a hydraulic excavator, said front attachment includes a boom, and said hydraulic actuator comprises a boom cylinder.

* * * * *